United States Patent [19]

Schwab

[11] Patent Number: 4,930,693

[45] Date of Patent: Jun. 5, 1990

[54] BODY RELIEF DISPLAY DEVICE

[76] Inventor: Kerstin Schwab, Gwand 1a, D-7245 Starzach 1, Fed. Rep. of Germany

[21] Appl. No.: 323,503

[22] Filed: Mar. 14, 1989

[30] Foreign Application Priority Data

Mar. 24, 1988 [DE] Fed. Rep. of Germany ... 8804003[U]

[51] Int. Cl.[5] ..... A41H 5/00

[52] U.S. Cl. ..... 223/66; 223/68; 223/71; 223/84

[58] Field of Search ..... 223/66, 69, 71, 81, 223/68, 120, 87; 211/169

[56] References Cited

U.S. PATENT DOCUMENTS

| | | | |
|---|---|---|---|
| 812,986 | 2/1906 | Galland | 223/71 |
| 2,014,436 | 9/1935 | Jacobsen | 223/66 |
| 2,085,335 | 6/1937 | Salgo | 223/66 |
| 2,089,266 | 10/1937 | Kalvin | 223/66 |
| 2,965,981 | 12/1960 | Giovetti | 223/66 |
| 4,805,816 | 2/1989 | Freund | 223/66 |

FOREIGN PATENT DOCUMENTS

| | | | |
|---|---|---|---|
| 8619456 | 9/1986 | Fed. Rep. of Germany . | |
| 1172234 | 11/1969 | United Kingdom | 354/223 |

OTHER PUBLICATIONS

Advertising Brochure-"Body Girl", Schamberger Presentations.

*Primary Examiner*—Werner H. Schroeder
*Assistant Examiner*—Bibhu Mohanty
*Attorney, Agent, or Firm*—Marmorek, Guttman & Rubenstein

[57] ABSTRACT

A body relief display device comprises a first torso form shaped as a relief of a body part and including a first outer contour, and a second torso form shaped as a relief of a body part and including a second outer contour, the second torso form being substantially identical to the first torso form. The first torso form is mounted on top of the second torso form. The second torso form also includes a flat surface formed as an extension of the second outer contour. A frame may be mounted on the flat surface. An article of clothing, for example, a swim suit may be fitted onto the first torso form, which is on top of the second torso form. A multiplicity of the devices may be hung by the frames of the second torso forms from a stand. In this way, a multiplicity of different articles of clothing can be presented for viewing and one can leaf through the display devices as the pages of a book.

7 Claims, 1 Drawing Sheet

BODY RELIEF DISPLAY DEVICE

BACKGROUND OF THE INVENTION

The instant invention relates to a body relief display device comprising a torso form in the shape of a relief of a body part and the contour of the torso form.

Such a torso form is known from German GM No. 86 19 456.9, applied for on July 19, 1986, and registered on Sept. 4, 1986. If the relief is made in the shape of a female torso, for example, a garment such as a swim suit can be stretched over it and the torso form can be used to present the swim suit.

It is the object of the present innovation to develop further a display device of this type so that a plurality of display devices of appropriate shape can be presented for selection. At the same time, stackability must not be impaired. Furthermore, it should be possible to secure the displayed garments against theft.

SUMMARY OF THE INVENTION

These and other objects are attained through the present invention wherein a first torso form in relief is placed on and connected to a second torso form in relief which is essentially identical to the first torso form. The second torso form includes a flat surface which is an extension of the contours of the relief of the body part.

A garment, e.g., a swim suit may be stretched over the first torso form; the first torso form is then attached to the second one or is connected to same. Since the second torso form has a flat surface which surrounds the second torso form as a border, the display device can then be framed. Several frames can be attached to a common stand so that one can leaf through such display devices practically as in a book.

BRIEF DESCRIPTION OF THE DRAWINGS

An embodiment of the invention in its advantageous further development is described hereinafter through the attached drawings wherein.

DETAILED DESCRIPTION OF THE INVENTION

Figure 1:
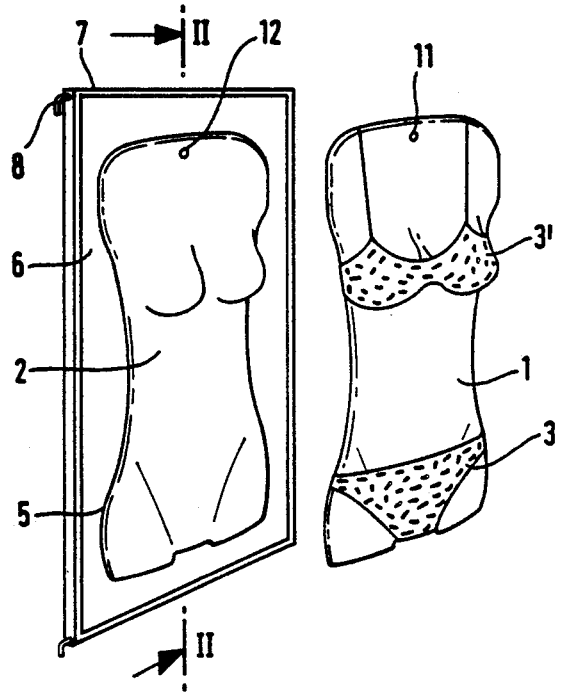
FIG. 1 shows the two torso forms which constitute the display device of the present invention in an exploded representation.

The illustrated body relief display device of the present invention comprises two torso forms 1 and 2. The first torso form 1 is in the shape of a female torso, i.e., it is made as a relief of a body part and includes an outer contour swim. A suit consisting of bottom 3 and top 3' is stretched over the torso form 1.

The second torso form 2 is essentially identical in configuration to the first torso form 1 but has in addition the flat surface area 6 as an extension of the outer contour 5 of the relief of the body part, i.e., in the present case, as an extension of the area which is made in the shape of a female torso. The outer limit of the flat area 6 is rectangular and is held in a frame 7. A wire hoop 8 is inserted into the upper and into the lower cross-pieces of the frame 7, making it possible to hang the entire display device on a stand 9 (FIG. 3).

Figure 2:
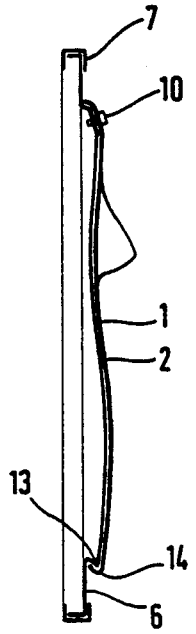
FIG. 2 shows a cross-section along line II—II of FIG. 1, but the first torso form is attached to the second torso form.

The first torso form 1 is attached to the second torso form 2. For this purpose it is simply placed on the second torso form 2 as shown in FIG. 2. The connection or attachment can be effected by means of a screw 10 for which appropriate openings 11 and 12 are provided at the upper edges of the two torso forms. The profile of the relief of the second torso form 2 can be provided with a small projection 13 into which hooks a corresponding crimping 14 of the first torso form.

Figure 3:
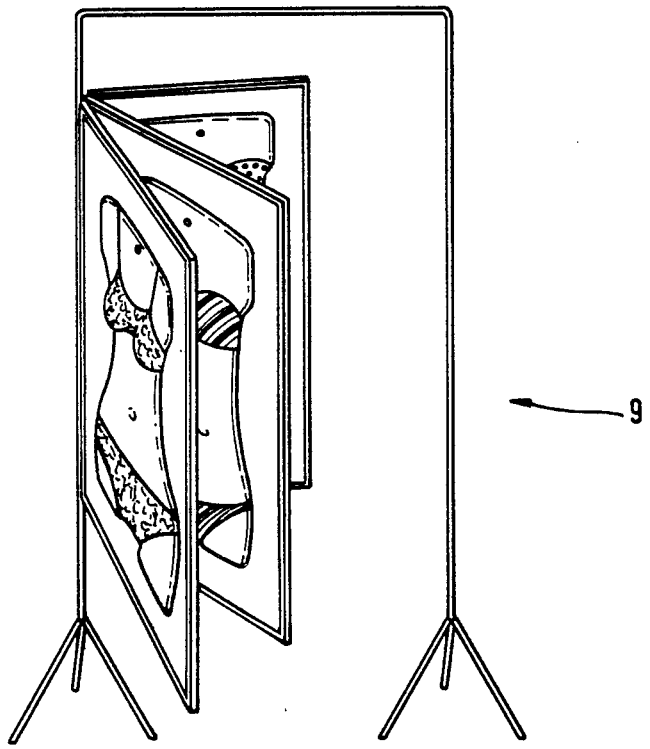
FIG. 3 shows an arrangement of several display items according to FIGS. 1 and 2 on a common supporting device.

If several such display devices are mounted on a stand 9 as shown in FIG. 3, it is possible to leaf through and examine the different display devices as the pages of a book.

While the invention has been described by reference to a specific embodiment, this was for purposes of illustration only. Numerous modifications and other embodiments are also possible within the scope of the present invention.

I claim:

1. A body relief display device comprising a first torso form shaped as a relief of a body part and including a first outer contour, a second torso form shaped as a relief of a body part and including a second outer contour, said second torso form being substantially identical to said first torso form, and a flat surface formed as an extension of said second outer contour, said first torso form being fitted on top of said second torso form.

2. The body relief display device of claim 1 further comprising a frame surrounding said flat surface.

3. The body relief display device of claim 2 further comprising means attached to said frame for hanging said body relief display device.

4. The body relief display device of claim 3 wherein said hanging means comprises a wire hook.

5. The body relief display device of claim 1 further comprising means for attaching said first torso form on top of said second torso form.

6. The body relief display device of claim 5 wherein said attaching means comprises a screw connection.

7. The body relief display device of claim 5 wherein said attaching means comprises a hook-like crimping on said first outer contour dimensioned to fit over a projection on said second outer contour.

* * * * *